United States Patent [19]

Graham

[11] 4,055,110

[45] Oct. 25, 1977

[54] FLAP LAMINATING MECHANISM FOR CARTON BLANKS

[75] Inventor: Robert H. Graham, Spokane, Wash.

[73] Assignee: R. A. Pearson Co., Spokane, Wash.

[21] Appl. No.: 690,159

[22] Filed: May 26, 1976

[51] Int. Cl.[2] ..... F01B 19/00

[52] U.S. Cl. ..... 93/49 R; 93/53 SD

[58] Field of Search ..... 93/49 R, 52, 49 M, 53 SD

[56] References Cited

U.S. PATENT DOCUMENTS

| | | | |
|---|---|---|---|
| 1,974,408 | 9/1934 | Bergstein | 93/49 M |
| 2,957,395 | 10/1960 | Meyer | 93/49 R |
| 3,589,249 | 6/1971 | Norbutas et al. | 93/49 R X |
| 3,896,711 | 7/1975 | Vuilleumier | 93/53 SD |

*Primary Examiner*—Roy Lake
*Assistant Examiner*—Paul A. Bell
*Attorney, Agent, or Firm*—Wells, St. John & Roberts

[57] ABSTRACT

A mechanism for automatically forming and laminating flaps of individual carton blanks as the blanks are moved along a prescribed longitudinal path. The mechanism includes a hopper for supplying individual carton blanks to a conveyor that leads along the prescribed path away from the hopper. A vacuum head is movably located below the hopper to remove successive blanks therefrom. The suction head moves the individual blanks downwardly into engagement with the conveyor. Lugs on the conveyor move the successive carton blanks along the path toward a flap folding mechanism. The flaps are folded over onto the carton blank in two separate steps. Firstly, the flaps are folded upwardly to a substantially 90 degree orientation with the remainder of the blank. This is done by a pair of pivoted arms on opposite sides of the conveyor. As the carton blank continues to move along the conveyor, the upwardly folded flaps are engaged and folded on downwardly into engagement with the remainder of the blank. Pressure rollers are provided at a discharge end of the conveyor to firmly press the folded flaps against the blank bodies. The rollers are driven at a speed greater than the operational speed of the conveyor so as to pull the blanks from engagement with the conveyor lugs and direct them to a carton forming station. The complete flap laminating operation is performed as the cartons move along the path toward a carton forming station.

8 Claims, 7 Drawing Figures

FIG. 1
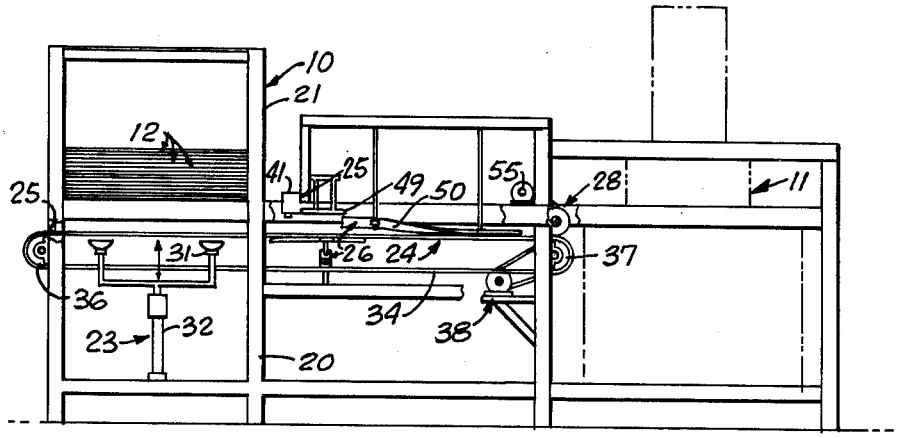
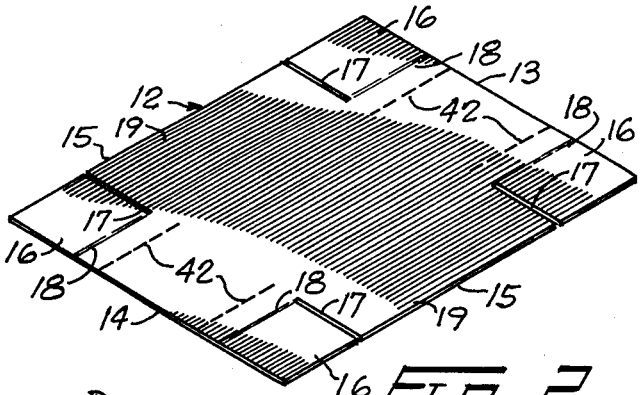
FIG. 2
FIG. 4
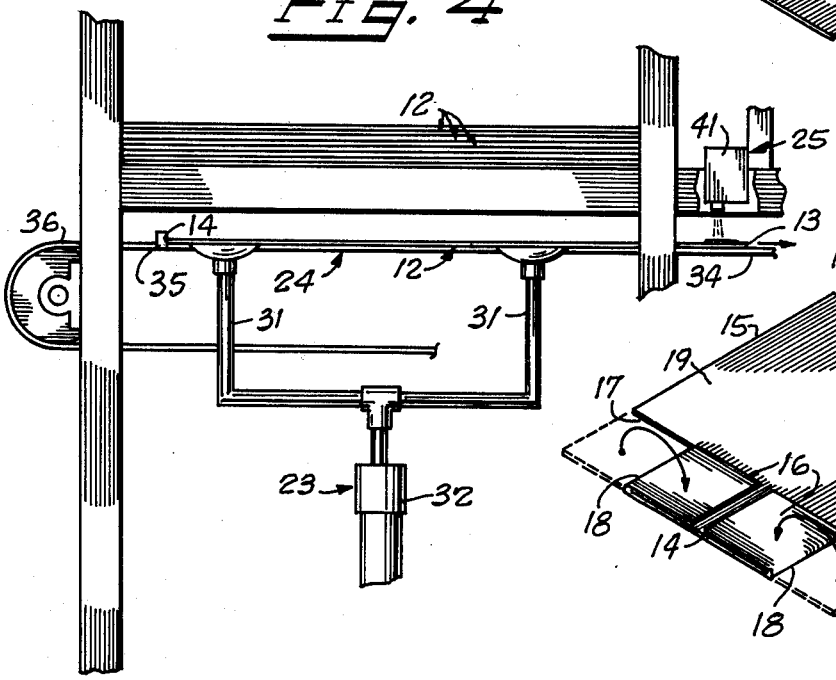
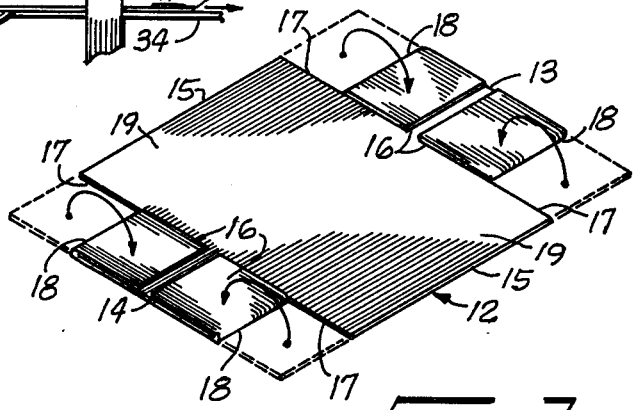
FIG. 3

FLAP LAMINATING MECHANISM FOR CARTON BLANKS

BACKGROUND OF THE INVENTION

The present invention is related to the field of carton forming mechanisms and more particularly to a mechanism adapted to fold corner flaps of a rectangular pre-cut carton blank over onto the blank body thereby laminating portions of the blank body.

It is not essentially new to provide a mechanism whereby pre-cut flaps are folded over onto a carton blank body to provide a double thickness lamination at a strategic location within the carton form to assure structural rigidity. However, such machines have previously performed this function at a station very near to the hopper in which the carton blanks are received and independently dispensed in response to the operation of an appropriate escapement mechanism. It is not unusual for the hopper to be located directly over a forming mandril whereby the corner flaps are partially folded upwardly as the carton blank is drawn from the hopper. Such mandrils serve their purpose, but necessarily interrupt the flow of carton forms through the machine and therefore considerably slow the production rate of the machine. It is therefore desirable to provide some form of flap laminating mechanism that will operate on a carton blank as it is moved from the hopper to a carton forming station, without interrupting or halting movement of the carton at any point along its path from the hopper to the forming station.

The present invention was conceived to perform the flap laminating operations as the individual cartons are moved continuously from the hopper to a forming station without interrupting or halting at any time the forward progress of the carton blanks. This is essentially accomplished in a two-step laminating procedure whereby glue is first applied to the carton blank adjacent the flap areas and a transversely spaced pair of pivot arms are swung upwardly against the flaps pivoting them up to an approximate 90 degree angle to the remainder of the associated carton blank. The arms hold the flaps in this position as the blanks continue to move toward the forming station until forward edges thereof engage flap folding irons. As soon as the flaps engage these irons, the folding arms are pivoted back downwardly out of the way of the approaching remainder of the carton blank. The irons function to fold the flaps downwardly and inwardly against the carton blank body and glue layers. Again, this is accomplished as the individual carton blanks move continuously toward the carton forming station.

SUMMARY OF THE INVENTION

A flap laminating mechanism is described herein for operation upon carton blanks of prescribed configuration. Each blank is rectangular with forward and rearward end edges joined by opposed side edges. A flap is located at each corner of the blank and is foldable about a fold line that is substantially parallel to the blank side edges. The laminating mechanism includes a supportive elongated framework with a hopper at one end thereof. The hopper is designed to receive a stack of the carton blanks. Means is provided for successively removing individual blanks from the hopper and delivering them to a conveying means. The conveying means receives the individual blanks and moves them continuously along a prescribed path leading from the hopper. A glue applicator means is situated on the framework adjacent to the prescribed path and downstream of the hopper. It is utilized as means for binding the flaps to their associated blank body by applying a layer of glue to the blanks adjacent the fold lines. Flap folding means is downstream of the glue applicator means and operates to fold the flaps over along the fold lines and against the carton blanks to sandwich the layer of glue as the carton blanks move continuously along the conveyor means. Means is also provided for pressing the folded flaps against the carton blanks and for removing the blanks from the conveyor means.

It is a first object of the present invention to provide a mechanism for laminating foldable flaps of carton blanks as the blanks are moved continuously along a single path toward a carton forming station.

It is a further object to provide such a laminating mechanism that involves relatively few moving parts and is therefore inexpensive to manufacture and is substantially maintenance free.

A still further object is to provide such a mechanism that can be adapted to varying forms of carton forming mechanisms and that will supply a continuous stream of carton blanks having laminated flaps thereon to the forming mechanism.

These and still further objects and advantages will become apparent upon reading the following description which, taken with the accompanying drawings, disclose a preferred form of the present invention.

BRIEF DESCRIPTION OF THE DRAWINGS

FIG. 1 is a simplified elevation view of the present invention;

FIG. 2 is a pictorial view of a typical carton blank that may be operated upon by the present invention;

FIG. 3 is a view similar to FIG. 1 only showing the flaps of the carton blank folded over to a laminated condition;

FIG. 4 is a diagrammatic operational view;

DETAILED DESCRIPTION OF A PREFERRED EMBODIMENT

Figure 5:
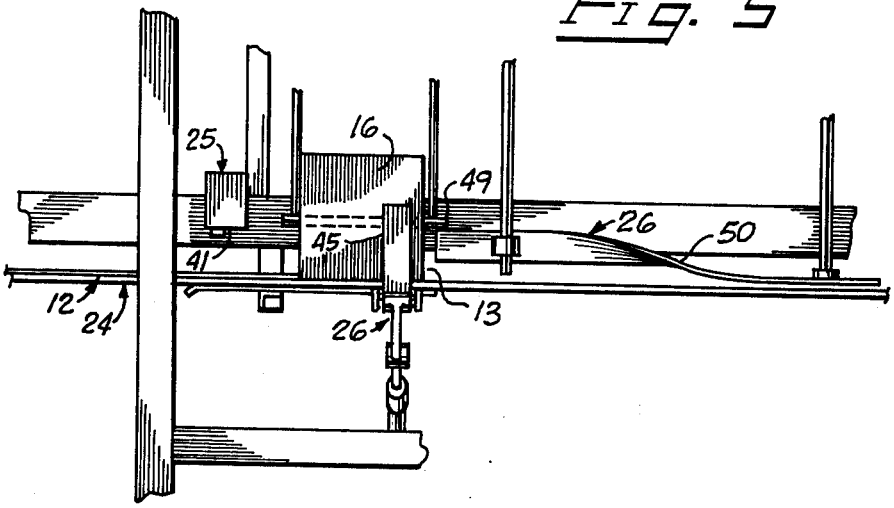
FIG. 5 is a view similar to FIG. 4 only showing different operational steps therein.

The mechanism embodying a preferred form of the present invention is generally illustrated in FIG. 1 of the accompanying drawings and is designated therein by the reference character 10. It is intended that the mechanism 10 be utilized in conjunction with a carton forming apparatus 11. The forming apparatus is shown in general dashed line outline in FIG. 1. It is well understood that the present mechanism could be utilized with several forms of carton forming machine that are well known in the tray and carton forming art.

It is intended that the present mechanism be utilized with a specific form of carton blank such as those shown in FIGS. 2 and 3. Specifically, such carton blanks 12 include forward and rearward end edges 13 and 14 that are interconnected by parallel opposed side edges 15. Together, the end edges 13 and 14 and side edges 15 define the rectangular configuration of the unfolded carton blank. Each blank however includes a flap 16 at each of its four corners. The flaps 16 are partially defined by cuts 17 extending inwardly from the side edges in parallel relation to the end edges. The cuts extend to fold lines 18 that are parallel to the side edges and extend between the end edges to inward terminal ends. The areas of the blanks located between cuts 17 on individual side edges 15 are indicated at 19.

The flaps are laminated against the body portions of the individual carton blanks as they are folded upwardly and over against the blank surfaces through an angle of approximately 180 degrees. The laminated portions of the carton are ordinarily provided to increase the structural stability of the finished carton as produced by the carton forming mechanism 11.

The present mechanism 10 includes an elongated supportive framework 20 that mounts a hopper 21 at one end thereof. A stack of individual carton blanks 12 are received by the hopper 21 and are successively removed therefrom by means of a blank removing mechanism 23. The individual blanks are received from the removing mechanism 23 by a conveying means 24. Means 24 directs the blanks along a prescribed path of travel leading away from the hopper to the carton forming mechanism 11.

Along the path defined by a conveying means 24 is a glue application means 25, a flap folding means 26, and a flap pressing and carton blank removing means 28.

As shown in FIGS. 1 and 4, the carton blank removing means 23 is simply comprised of a suction head 31 mounted on the piston end of a ram cylinder 32. The cylinder is upright and mounted at its base end to the frame 20. It is also located directly below the hopper 21 so as to enable vertical movement of the suction head between a position engaging the bottom carton blank of the stack 22 and a lower position wherein the blank is removed from the hopper and lowered vertically to the elevation of conveying means 24. Pneumatic suction may be provided to the suction head by conventional mechanism (not shown) which may be regulated to operate continuously or intermittently in relation to the functioning of cylinder 32.

The conveying mechanism 24 is simply comprised of an endless chain conveyor 34 that is positioned longitudinally on the framework 20 to extend from an input end 36 under hopper 21 to a discharge end 37 adjacent the carton forming mechanism 11. The chain conveyor 34 includes at least one protruding lug 35 thereon that engages the rearward side edge 14 of each partition presented by the removing means 23. The conveyor is operated continuously by a conventional drive mechanism 38 (FIG. 1). It may therefore be understood that the successive carton blanks 12 are moved continuously without interruption by the lugs 35 from the hopper 21 toward the carton forming mechanism 11. It may also be understood that the working flight of chain conveyor 34 defines the preselected path of travel for the successive partition blanks. The various flap laminating elements are situated on either side of this conveyor to perform their individual functions as the blanks move by.

The first operation that each carton blank is exposed to upon leaving the hopper and engaging conveyor mechanism 24, is the application of a layer or layers of glue from laterally spaced overhead glue head 41. The glue heads 41 comprise the glue application means 25. They are spaced apart transversely above the blank path so as to apply a layer or layers of glue to the blank body inwardly adjacent to the individual flaps 16. The location of the glue layers is indicated by dashed lines in FIG. 2. Other glue applying mechanism may be located at this point to apply additional layers of glue for later carton forming functions. However, for the purpose of the present invention, only two transversely spaced glue heads 41 need be supplied to produce the glue strips 42 for the purpose of laminating the flaps 16 to a carton blank.

As the successive blanks move past the glue applicator means 25, the individual flaps 16 are folded upwardly and subsequently inward and downwardly against the carton blank bodies through operation of a pair of pivot arms 45 and folding irons 50 which comprise the flap folding means 26. The flaps 16 are folded over onto each carton blank in two successive steps. Firstly, the flaps are folded upwardly to an approximate 90 degree angle with the remainder of the carton blank. This is accomplished by the spaced pair of pivot arms 45 which are movable between a lowered position clear of carton blanks moving along the conveyor flight of chain conveyor 34 and a raised position in engagement with a laminating flap 16 folded upwardly thereby along its laminating fold line 18. The arms 45 are mounted to frame 20 for pivotal movement about the transversely spaced axes of pivots 46. The pivot axes are parallel to the carton blank path and are spaced apart by a transverse distance approximately equal to the transverse distance between the fold lines 18.

Figure 7:
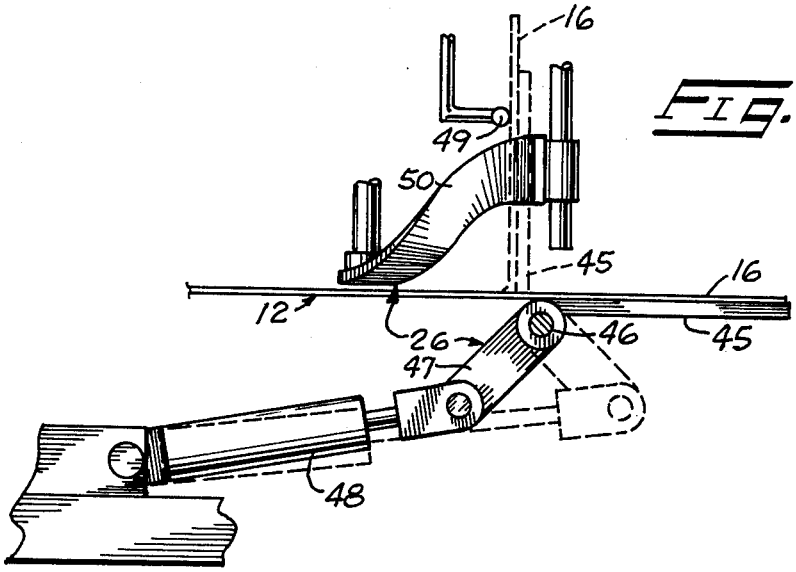
FIG. 7 is a fragmentary section view illustrating components of the present invention in detail.

Each pivot arm 45 is connected by a crank lever 47 to a ram cylinder 18. Cylinder 48 functions to pivot the attached arm 45 from a horizontal condition (solid lines, FIG. 7) to an upright condition (dashed lines, FIG. 7). The arms 45 must pivot clear of the oncoming center portions 19 as the carton blank moves on forwardly toward carton forming mechanism 11. Timed operation of the cylinders 48 to appropriately pivot the arms 45 is controlled through conventional electronic or electromechanical control apparatus well known in the art.

Inward guide bars 49 are provided to cooperate with the arms 45 in guiding the partially folded flaps as they move toward the pair of folding irons 50. The guide bars 49 are stationary and mounted to the general framework 20.

The irons 50 are, like arms 45, transversely spaced on opposite sides of the conveyer 34. The irons perform the second folding step by receiving the partially folded upright flaps from the arms 45 and progressively folding them inward and downwardly as the carton moves toward forming mechanism 13. The irons 50 are stationary and mounted directly to the general framework 20.

They extend downstream along the length of the conveyor flight from locations respectively adjacent the two pivot arms 45. The distance between each pivot arm 45 and the stationary folding iron 50 associated thereby is less than the laminating flap length along a flap 16 parallel to the longitudinal path of the conveyor 34, enabling each laminating flap 16 to momentarily overlap both the pivot arm 45 and the stationary folding iron 50 while the carton blank is moving continuously along the upper flight of the conveyor 34.

The flap pressing and blank removing blanks 28 is simply comprised of a set of rollers 53 mounted on a common shaft 54. The rollers are rotated by a drive means 55 (FIG. 1) at a rate considerably faster than the rate of travel for the conveyor lugs 35. The rollers 53 are located upwardly adjacent to the path for the blanks so that the peripheral roller surfaces will engage and press the flaps downwardly against the glue lines and blank body. Further, the rotating rollers will slide a blank forwardly at the increased rate of speed and thereby move the blank to the carton forming mechanism ahead of the lugs 35. This feature assures that the rearward blank edge will not be damaged as the lugs move downwardly and around the conveyor sprockets at the discharge end 37.

An operational cycle of the present mechanism required to laminate the flaps of a single carton blank begins with the removal of the blank from hopper 21. Removing means 23 moves the carton blank downwardly from the hopper into direct engagement with the working flight of conveyor 34. The blank will remain at rest on the conveyor, sliding along the working flight until a lug 35 engages the rearward end edge 14. At this point, the blank begins its forward journey to the carton forming mechanism. As the blank progresses forwardly, the glue applicator means 25 is actuated automatically to apply the layers 42 of glue to the flap or blank body.

As the blank continues to move along the selected path, the forward flaps come into alignment with the arms 45. At this point, the cylinders 48 are actuated to pivot the arms 46 upwardly against the forward pair of flaps, folding them upwardly to the upright condition as shown in FIG. 5. The arms remain in the upright condition to guide the partially folded flaps along as they move into engagement with the folding irons 50. The guide bars 49 also assist arms 45 in the guiding function.

As soon as the flaps engage the folding irons 50, the cylinders 48 are again actuated to retract, pulling the arms 45 back to a horizontal condition clear of the path of the forwardly progressing blank. Irons 50 serve to progressively fold the flaps downwardly and press them against the previously applied layers of glue. As this is hapening, the rearward pair of flaps move into alignment with arms 45.

Figure 6:
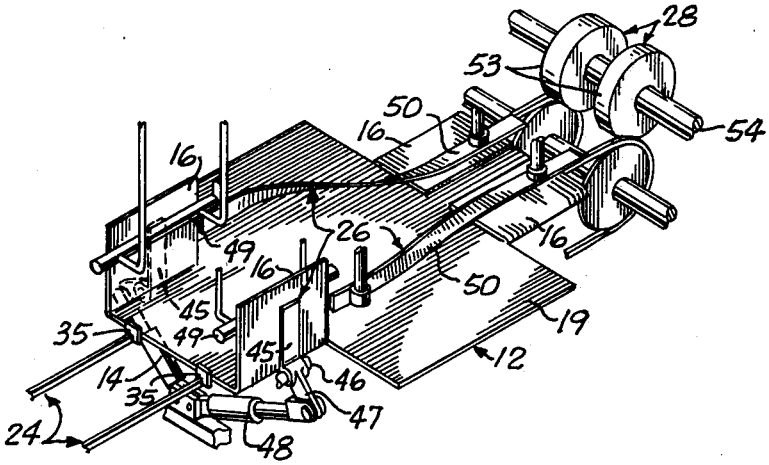
FIG. 6 is a diagrammatic pictorial view again illustrating operation of the present invention.

The arms 45 are again swung upwardly to fold the rearward flap pair upwardly to the partially folded configuration as indicated in FIG. 6. Arms 45 may remain in the upright condition until the flaps are engaged by irons 50. The arms are then pivoted downwardly again to the horizontal position to await the next successive carton blank.

The irons 50 again function to fold the rearward pair of flaps downwardly against the carton blank surface and glue layers. Rollers 53, at this point, engage the forward edge 13 of the blank to press the flaps firmly against the blank body and slide the blank forwardly from engagement with the conveyor lugs 35. This action completes a full cycle of operation.

It may have become evident from the above description and attached drawings that various changes and modifications may be made therein without departing from the intended scope of the present invention. It is therefore intended that only the following claims be taken as definitions of my invention.

What I claim is:

1. A mechanism for laminating pre-cut flaps on planar carton blanks as the carton blanks move to a carton forming station, wherein each carton blank is rectangular in configuration with transverse forward and rearward end edges joining opposed logitudinal side edges, and wherein a laminating flap is located at each corner of the blank, the laminating flaps being transversely foldable about longitudinal laminating fold lines substantially parallel to the side edges of the carton blank, the transverse width of the carton blank area between transversely aligned laminating fold lines being at least twice as great as the transverse width of each laminating flap from its laminating fold line to the side edge of the blank, said mechanism comprising:

a stationary framework;

a longitudinal, upwardly-facing, powered conveyor flight extending along the framework for elevationally supporting individual carton blanks and for continuously moving the carton blanks in succession along a longitudinal path extending the length of the conveyor flight from an infeed end to a discharge end;

carton blank delivery means for directing individual carton blanks onto the conveyor flight adjacent its infeed end, with the longitudinal side edges and laminating fold lines of the carton blanks arranged parallel to the longitudinal path of the conveyor flight with respect to the framework;

a pair of pivot arms mounted to said framework at opposite sides of the conveyor flight, said pivot arms being movable about longitudinal axes parallel to the conveyor path, each pivot arm being movable between a lowered position wherein it is clear of carton blanks moving along the conveyor flight, and a raised position where it engages a laminating flap folded upwardly thereby along its laminating fold line;

stationary folding irons extending downstream along the length of the conveyor flight at each side thereof from locations adjacent the respective pivot arms, said folding irons having inwardly-facing surfaces for engagement by the raised laminating flaps folded by the raised pivot arm adjacent thereto and for folding the raised flaps inwardly over their laminating fold lines and against the adjacent areas of the carton blanks in response to the continuous movement imparted to the carton blank by the conveyor flight;

the distance between each pivot arm and the stationary folding iron associated therewith being less than the laminating flap length measured parallel to the longitudinal path of the conveyor flight, whereby each laminating flap can momentarily overlap both the pivot arm and stationary folding iron adjacent thereto while moving continuously along the longitudinal path of the conveyor flight.

2. The mechanism set out in claim 1 further comprising:

powered cylinder means on said framework operatively connected to the pivot arms for moving the pivot arms between their lowered and raised positions in a timed relation with respect to the continuous movement of the conveyor flight, whereby the laminating flaps are folded without engagement of the carton blank areas longitudinally between them.

3. The mechanism set out in claim 1 wherein the carton blank delivery means comprises an upright hopper for holding a stack of carton blanks directly above the conveyor flight.

4. The mechanism as set out in claim 3 further comprising a suction head mounted to an upright cylinder assembly located directly below the hopper, said cylinder being operable to move the suction head upwardly into engagement with the lower carton blank of the stack within the hopper and to move the suction head downwardly below the conveyor flight.

5. The mechanism set out in claim 1 further comprising roller means for engaging the successive carton blanks at the discharge end of the conveyor flight, pressing the folded laminating flaps against the carton blanks, and subsequently removing the carton blanks from the conveyor flight while in a planar condition.

6. The mechanism set out in claim 1 wherein the conveyor flight is comprised of an endless conveyor chain with lugs thereon for engaging the carton blanks and pushing them along said path in a planar condition; and further comprising:

a set of rollers on the framework above the discharge end of the conveyor flight; and drive means on said framework operably connected to the rollers for rotating the rollers about a coaxial axis perpendicualr to the path of the carton blanks on the conveyor flight and at a speed greater than the translational speed of the conveyor flight along said path, whereby carton blanks engaged by the rollers are pulled forward from engagement by the conveyor lugs.

7. the mechanism set out in claim 1 wherein the conveying means is comprised of a driven endless conveyor chain having lugs thereon for engaging the end edges of successive carton blanks and for pushing them along the longitudinal path.

8. The mechanism set out in claim 1 further comprising glue applicator means on the framework at a location downstream of the carton blank delivery means and upstream of the pair of pivot arms, for applying a layer of glue to the blanks at positions transversely adjacent to the laminating fold lines.

* * * * *